US005755949A

United States Patent [19]

Amor

[11] Patent Number: 5,755,949

[45] Date of Patent: May 26, 1998

[54] ELECTROCHEMICAL GRAINING METHOD

[75] Inventor: Martin Philip Amor, Banbury, England

[73] Assignee: AGFA-Gevaert AG, Leverkusen, Germany

[21] Appl. No.: 361,817

[22] Filed: Dec. 22, 1994

[30] Foreign Application Priority Data

Dec. 22, 1993 [GB] United Kingdom ..... 9326150

[51] Int. Cl.[6] ..... C25F 3/04; C25D 11/04; C25D 11/16

[52] U.S. Cl. ..... 205/153; 205/201; 205/214; 205/220; 205/659; 205/660; 205/704; 205/921

[58] Field of Search ..... 204/129.4, 129.43, 204/DIG. 8, DIG. 9; 205/139, 153, 172, 201–202, 214, 921

[56] References Cited

U.S. PATENT DOCUMENTS

| | | | |
|---|---|---|---|
| 2,679,498 | 5/1954 | Seven et al. | 260/141 |
| 2,760,863 | 8/1956 | Plambeck, Jr. | 95/5.6 |
| 3,050,502 | 8/1962 | Mellan | 260/72.5 |
| 3,060,023 | 10/1962 | Burg et al. | 96/28 |
| 3,181,461 | 5/1965 | Fromson | 101/149.2 |
| 3,615,385 | 10/1971 | Lind | 96/1 |
| 3,653,886 | 4/1972 | Lind et al. | 96/1 R |
| 3,969,118 | 7/1976 | Stahlhofen et al. | 96/91 D |
| 4,019,972 | 4/1977 | Faust | 204/159.15 |
| 4,066,453 | 1/1978 | Lind et al. | 96/1 R |
| 4,088,498 | 5/1978 | Faust | 96/115 P |
| 4,101,323 | 7/1978 | Buhr et al. | 96/35 |
| 4,247,611 | 1/1981 | Sander et al. | 430/286 |
| 4,311,782 | 1/1982 | Buhr et al. | 430/270 |
| 4,387,151 | 6/1983 | Bosse et al. | 430/175 |
| 4,424,270 | 1/1984 | Erdmann et al. | 430/166 |
| 4,468,295 | 8/1984 | Pliefke | 204/33 |
| 4,476,006 | 10/1984 | Ohba et al. | 205/214 X |
| 4,482,434 | 11/1984 | Pliefke | 204/33 |
| 4,534,834 | 8/1985 | Zdenek | 205/139 X |
| 4,555,469 | 11/1985 | Erdmann et al. | 430/168 |
| 4,560,636 | 12/1985 | Stahlhofen | 430/165 |
| 4,853,093 | 8/1989 | Brenk et al. | 204/37.6 |
| 4,915,800 | 4/1990 | Nakanishi et al. | 204/129.4 |
| 5,045,157 | 9/1991 | Nishino et al. | 204/DIG. 9 |
| 5,082,537 | 1/1992 | Stroszynski et al. | 205/139 |
| 5,213,666 | 5/1993 | Nishino | 204/129.43 |
| 5,264,110 | 11/1993 | Atkinson et al. | 205/214 |

FOREIGN PATENT DOCUMENTS

| | | |
|---|---|---|
| 1 046 865 | 1/1979 | Canada . |
| 0 021 428 | 1/1981 | European Pat. Off. . |
| 0 055 814 | 7/1982 | European Pat. Off. . |
| 0 093 960 | 11/1983 | European Pat. Off. . |
| 0 269 851 | 6/1988 | European Pat. Off. . |
| 0 317 866 | 5/1989 | European Pat. Off. . |
| 596 731 | 4/1934 | Germany . |
| 854 890 | 12/1951 | Germany . |
| 865 109 | 2/1952 | Germany . |
| 879 203 | 7/1952 | Germany . |
| 894 959 | 7/1952 | Germany . |
| 938 233 | 8/1955 | Germany . |
| 1 109 521 | 6/1961 | Germany . |
| 1 117 391 | 11/1961 | Germany . |
| 1 118 606 | 11/1961 | Germany . |
| 1 120 273 | 12/1961 | Germany . |
| 1 124 817 | 3/1962 | Germany . |
| 1 138 399 | 10/1962 | Germany . |

(List continued on next page.)

OTHER PUBLICATIONS

J. Kosar, "Light-Sensitive Systems: Chemistry and Application of Nonsilver Halide Photographic Processes", pp. 46–102, 137–193 and 321–357 no date.

*Primary Examiner*—Donald R. Valentine
*Attorney, Agent, or Firm*—Foley & Lardner

[57] ABSTRACT

A plate-, foil- or web-shaped workpiece of aluminum or an alloy thereof is subjected, in an electrolyte bath, to an alternating current at a frequency of 0.1 to 25 Hz. During the AC treatment, an anodic potential is imposed on the workpiece, in the range of 0 to 5 Volts. The total charge input is 10 to 60 kC/m$^2$. Prior to the electrochemical graining, the workpiece is mechanically grained. After the graining steps, an etching treatment as well as an anodical oxidation and, thereafter, a hydrophilization are performed.

12 Claims, 7 Drawing Sheets

7 Vac, 10s, 0.25Hz, +3Vdc

FOREIGN PATENT DOCUMENTS

Figure 8:
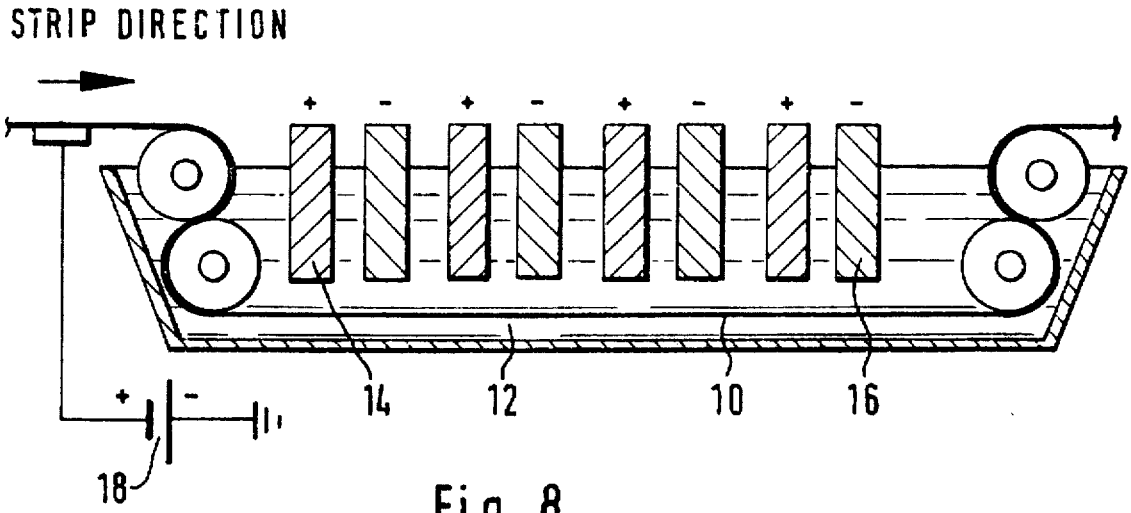

| | | |
|---|---|---|
| 1 138 400 | 10/1962 | Germany . |
| 1 138 401 | 10/1962 | Germany . |
| 1 142 871 | 1/1963 | Germany . |
| 1 144 705 | 3/1963 | Germany . |
| 1 154 123 | 9/1963 | Germany . |
| 1 522 497 | 9/1969 | Germany . |
| 15 72 312 | 1/1970 | Germany . |
| 20 64 079 | 7/1972 | Germany . |
| 23 22 046 | 11/1974 | Germany . |
| 23 31 377 | 1/1975 | Germany . |
| 20 65 732 | 8/1975 | Germany . |
| 712 606 | 7/1954 | United Kingdom . |
| 1 230 447 | 5/1971 | United Kingdom . |
| 1 312 925 | 4/1973 | United Kingdom . |
| 92/21975 | 12/1992 | WIPO . |
| 92/22688 | 12/1992 | WIPO . |

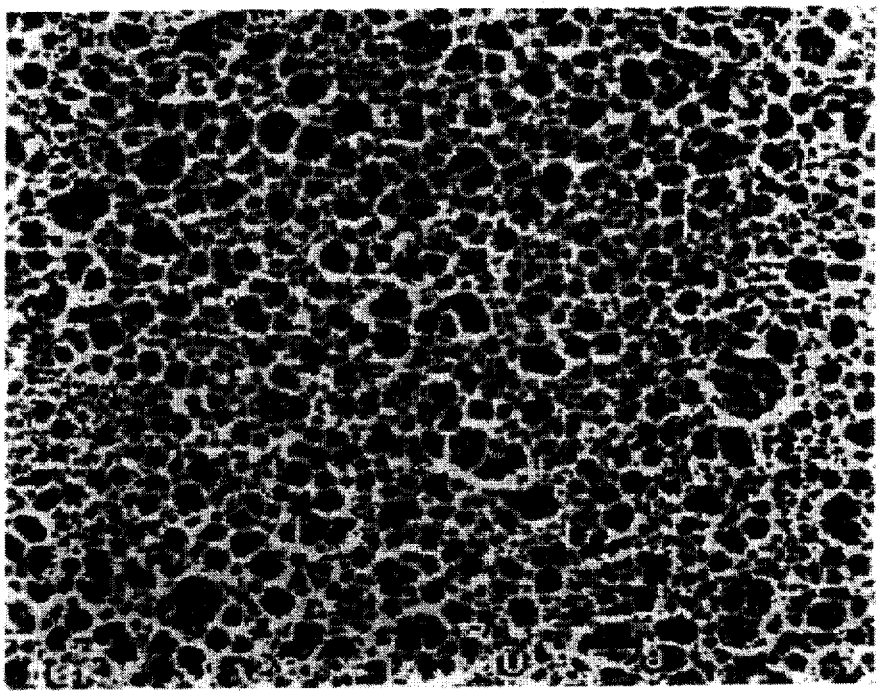
7 Vac, 30 s, 50 Hz, -1 Vdc Fig. 1
PRIOR ART
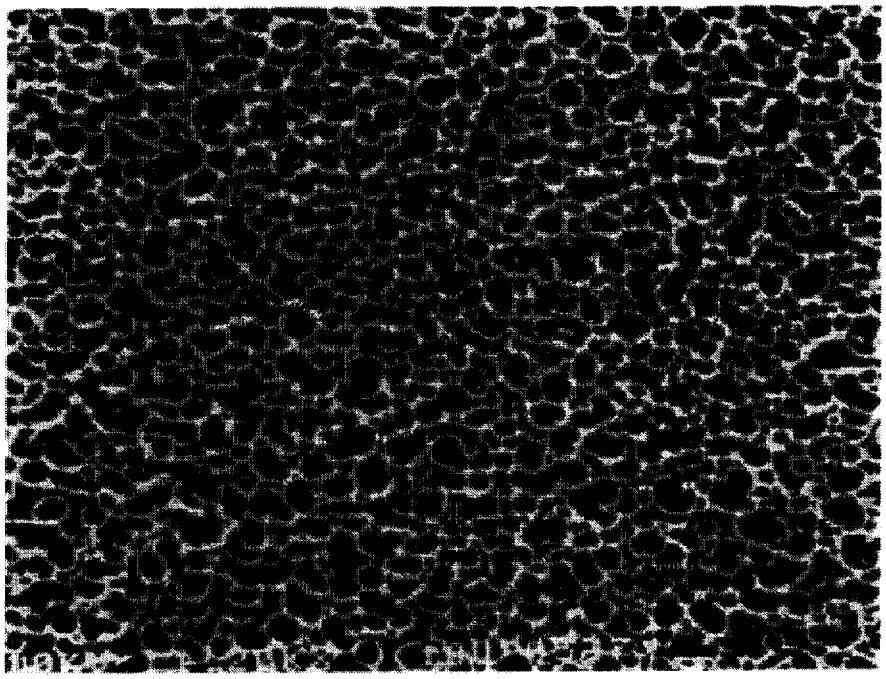
7 Vac, 10 s, 0,25 Hz, +3 Vdc Fig. 2

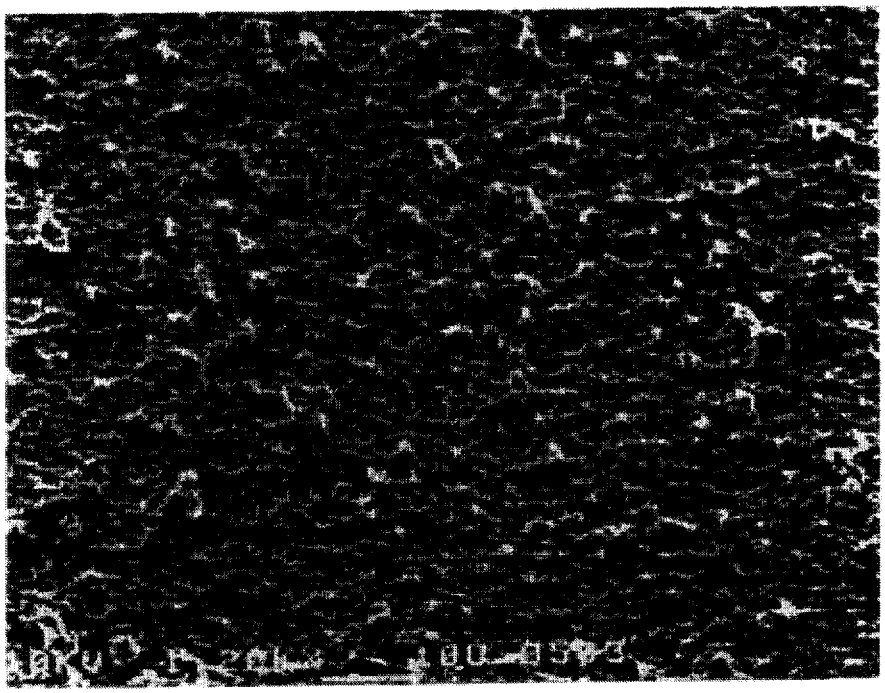
7 Vac, 30s, 5 Hz, + 2 Vdc Fig. 3a
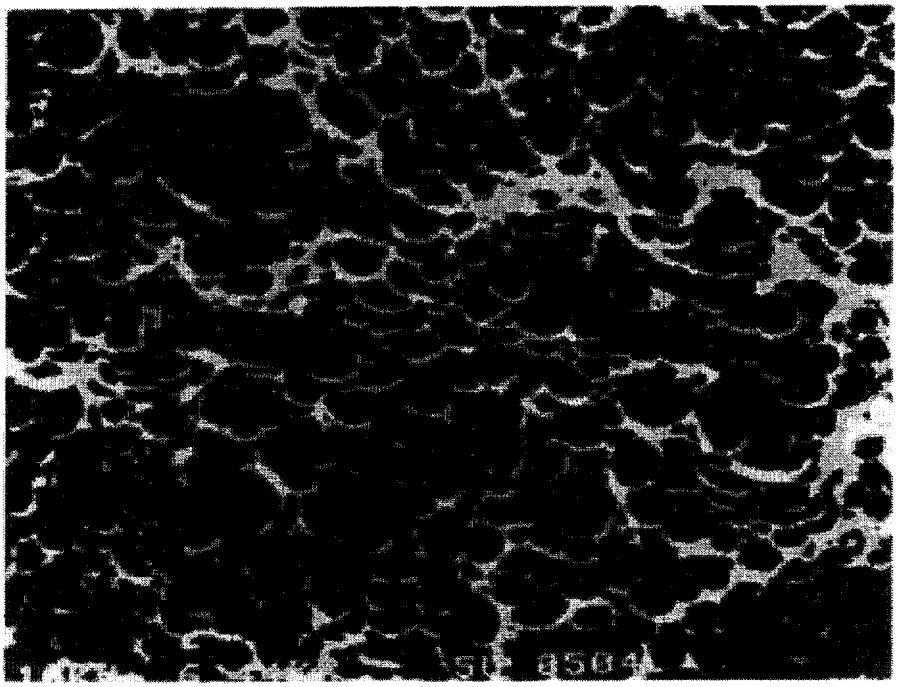
7 Vac, 30s, 5 Hz, + 2 Vdc Fig. 3b

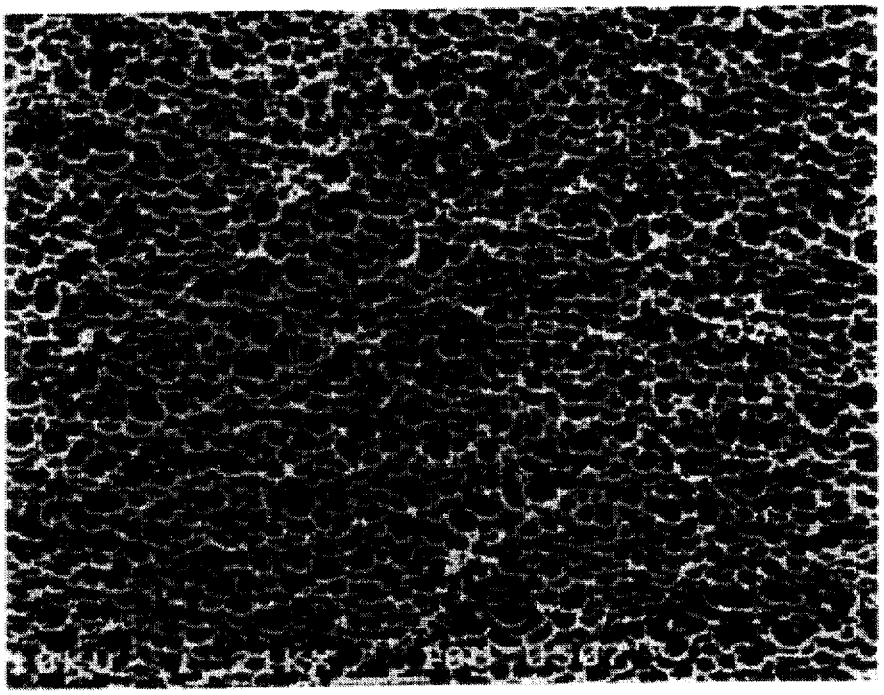
7 Vac, 30 s, 1 Hz, + 2 Vdc Fig. 4
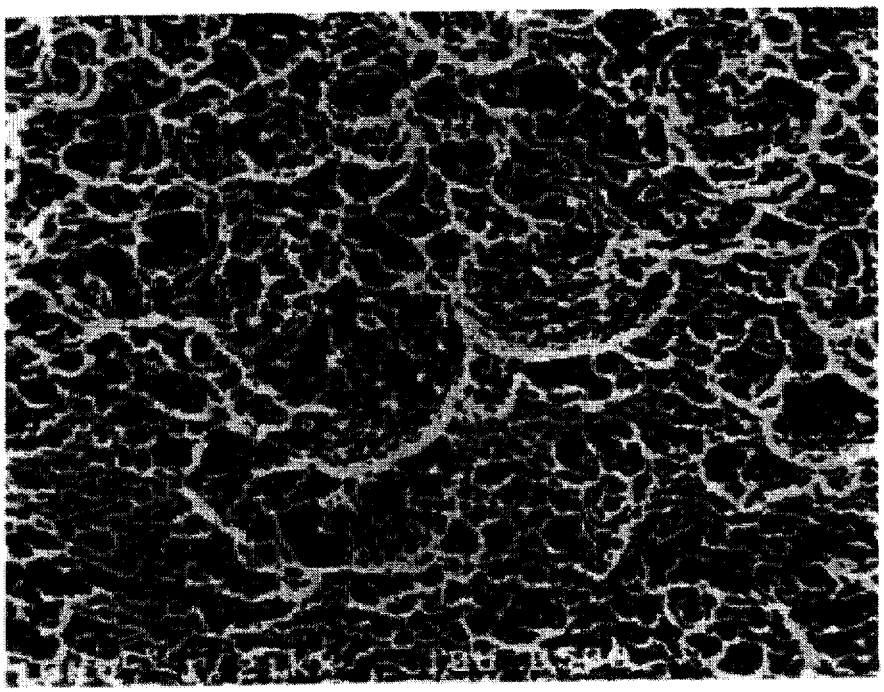
7 Vac, 30 s, 50 Hz, + 2 Vdc Fig. 5

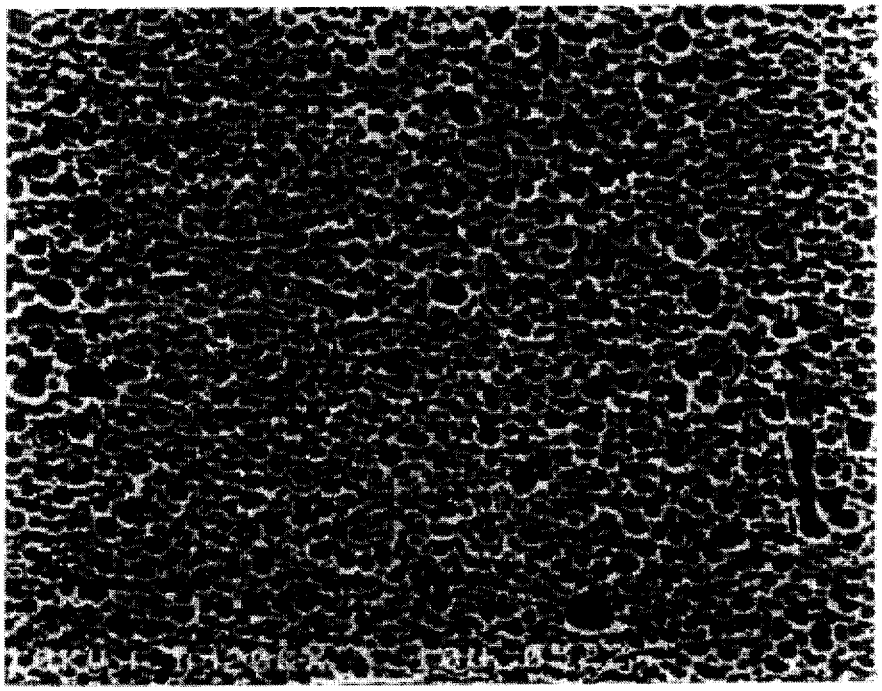
7 Vac, 10s, 1Hz, + 2 Vdc Fig. 6a
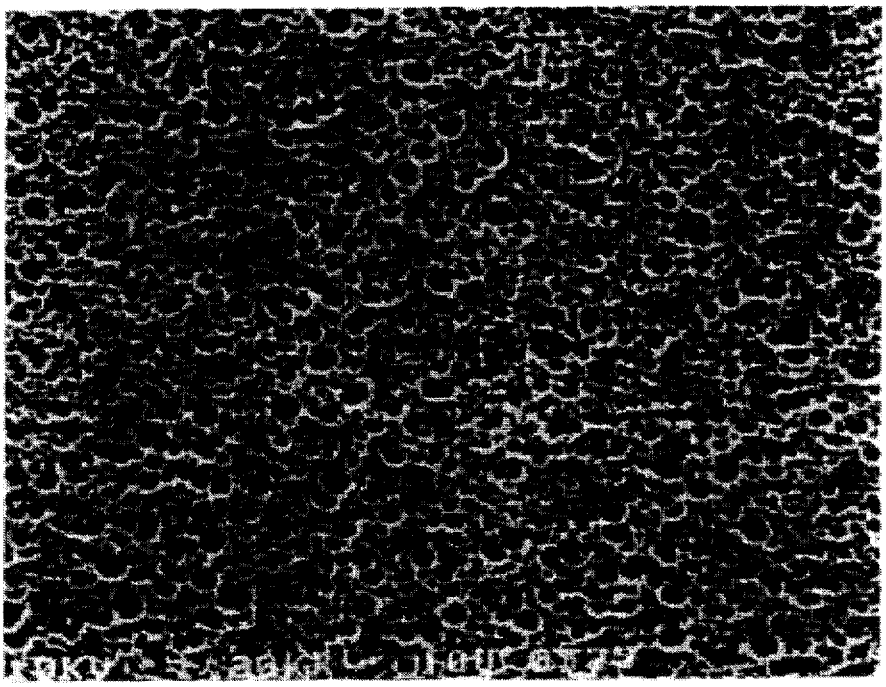
7 Vac, 10s, 1Hz, 0 Vdc Fig. 6b

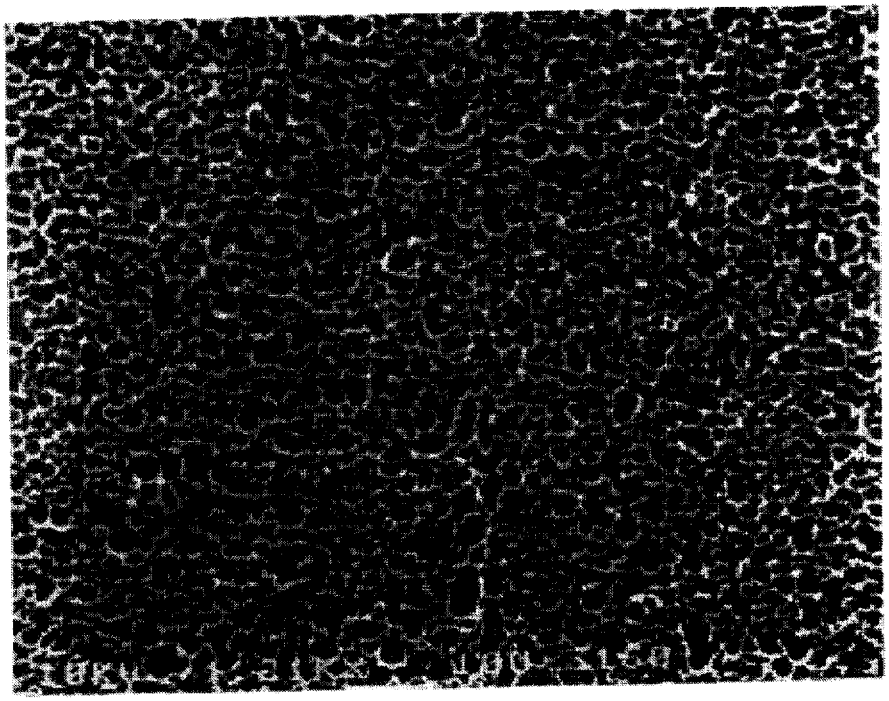
10Vac, 3s, 1Hz, +5Vdc Fig. 7a
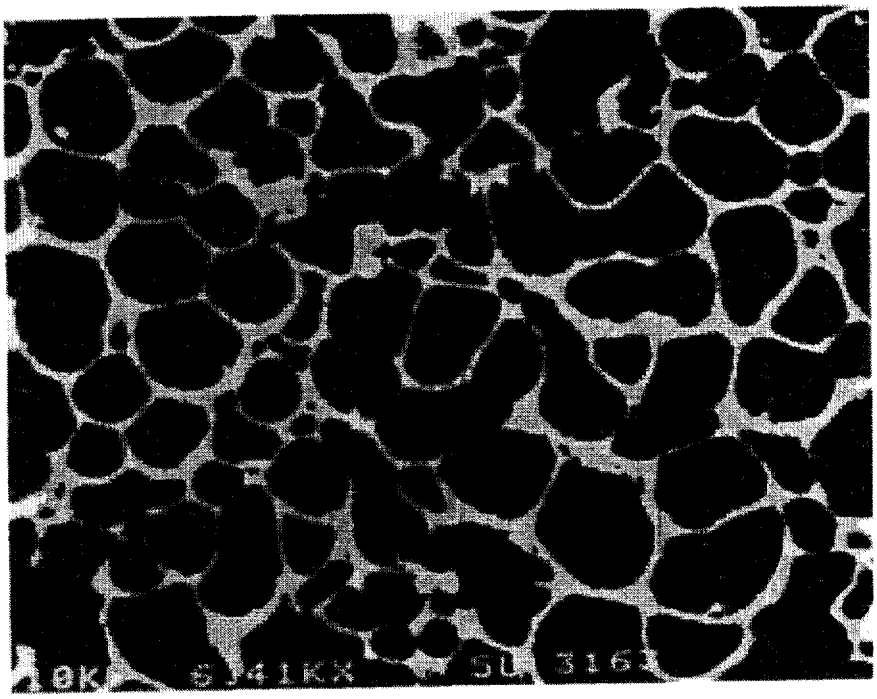
10Vac, 3s, 1Hz, +5Vdc Fig. 7b

ELECTROCHEMICAL GRAINING METHOD

This invention relates to a method of electrochemically graining a surface of a plate-, foil- or web-shaped workpiece of aluminum or an aluminum alloy.

As a result of using low frequency AC, together with other features as described below, the coulombic input to the workpiece can be substantially reduced. A major use for the invention will be in the electrochemical graining or roughening of aluminum metal sheets for use as lithographic plate supports.

U.S. Pat. No. 4,482,434 describes a process for electrochemical roughening aluminum or alloys thereof under the action of an alternating current having a frequency in the range from 0.3 to 15 Hz.

U.S. Pat. No. 4,468,295 describes a process for electrochemical roughening aluminum or alloys thereof under the action of an alternating current which is generated by superimposing two different frequencies. Neither patent contains any suggestion that the total coulombic charge input required to electrograin sheet for use as a lithographic plate support can be reduced.

EP 317 866 A describes a method for producing an aluminum support for a printing plate, by passing the support through an acidic electrolyte past a series of electrodes maintained alternately as cathodes and anodes. Again, there is no suggestion that the total coulombic charge input can be reduced.

WO 92/22688 describes a method of electrochemical roughening an aluminum metal sheet for use as a lithographic plate support by subjecting the sheet in an electrolyte to an alternating current treatment. A transition metal component (added to the sheet or the electrolyte) permits a reduction in the total coulombic charge input to 35–75 $kC/m^2$.

WO 92/21975 describes a method of electrochemically roughening an Al sheet for use as a lithographic plate support, by subjecting the sheet to AC treatment in an electrolyte, wherein the potential of the sheet is biased, first in a cathodic (or anodic) direction and subsequently in an anodic (or cathodic) direction. That method permitted some reduction in the total coulombic charge input required to fully grain the surface.

An aluminum workpiece that is immersed in an electrolyte in order to be subjected to AC electrochemical graining, carries on its surface an aluminum oxide film. During that part of the AC cycle when the workpiece is at a cathodic potential, the oxide film is disrupted at numerous points which provide nuclei for initiating pit growth. During the part of the AC cycle when the workpiece is anodic, pits grow at the pre-formed nuclei. It appears that these two events operate at different speeds. Using conventional 50 Hz AC, the cathodic parts of the AC cycle may be too short for effective nucleation, and it may therefore be helpful to bias the aluminum sheet in a cathodic direction. At lower AC frequencies, the cathodic part of the AC cycle may be longer than optimum for pit nucleation.

Historical development and convenience has led to commercial graining processes normally being operated at high frequency. Experiments with DC power shows that coverage is very slow and it can be demonstrated that the cathodic cycle is necessary for the initiation of pits. However, the time spent in the cathodic cycle is not contributing significantly to pit growth as such and it would be beneficial to minimise the proportion of time and power expended in this process. Similarly if coverage is to be maximised it preferably would be an advantage to form pits initially only on the non-reacted regions of the surface.

The fineness of the finish at present is limited by the need that the whole surface is covered with pits and to achieve this multiple pitting events occur on some sites before sufficient of the nonreacted surface has been pitted. So electrograining takes a long time to cover the whole surface and consequently is expensive in terms of both time and power consumption.

By increasing the time taken from the cessation of pit growth to the onset of the next growth period, the existing pits can be forced to passivate and new initiation sites form in the overlying film of the unreacted surface making the formation of new pits much more favourable than continuing with an existing pit site. Consequently the rate of coverage is maximised and the pits produced are very uniform.

This uniform and rapid coverage is particularly advantageous if the sheet has been preroughened as is current practice for some types of long run plates using e.g. scratch brushing. The process of this invention improves the efficiency of producing lithographic sheet and its performance. Reduced power consumption also means less consumption of the graining electrolyte and reduces the effluent treatment and disposal costs.

This invention provides a method of electrochemcically graining a surface of an aluminum workpiece, which method comprises subjecting the workpiece in an electrolyte to an alternating current at a frequency of 0.1 to 25 Hz. The invention also involves the use of one or more of various other features which are discussed below as a) to e).

In the following, the invention is described in detail with reference to the accompanying drawings, which illustrate in FIGS. **1–7*b* surface topographies of aluminum alloy sheets subjected to different graining conditions; in FIG. 8 an electrolyte bath arrangement, in schematic view, through which a continuous aluminum web passes; and in FIGS. 9–12 graphs of voltage of the alternating electric current against time to which an aluminum alloy web is subjected when it passes the electrolyte bath shown in FIG. 8**.

Figure 9:
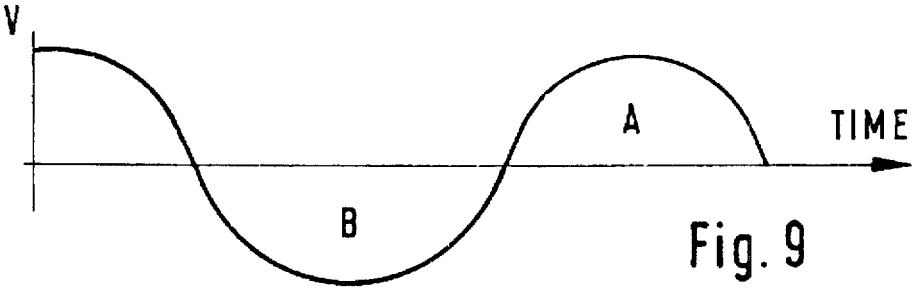
Figure 10:
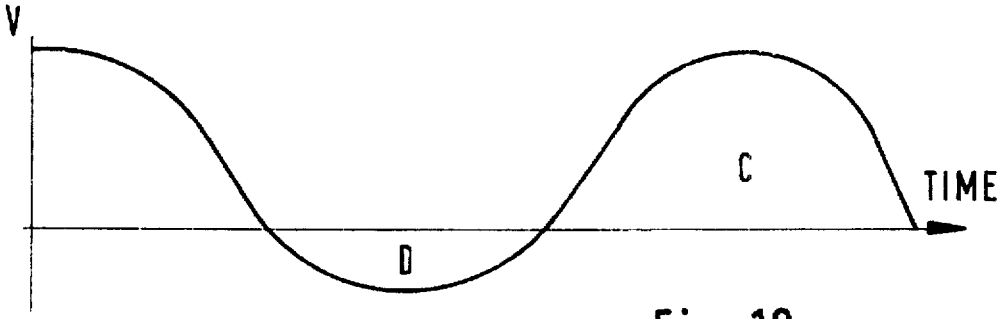
Figure 11:
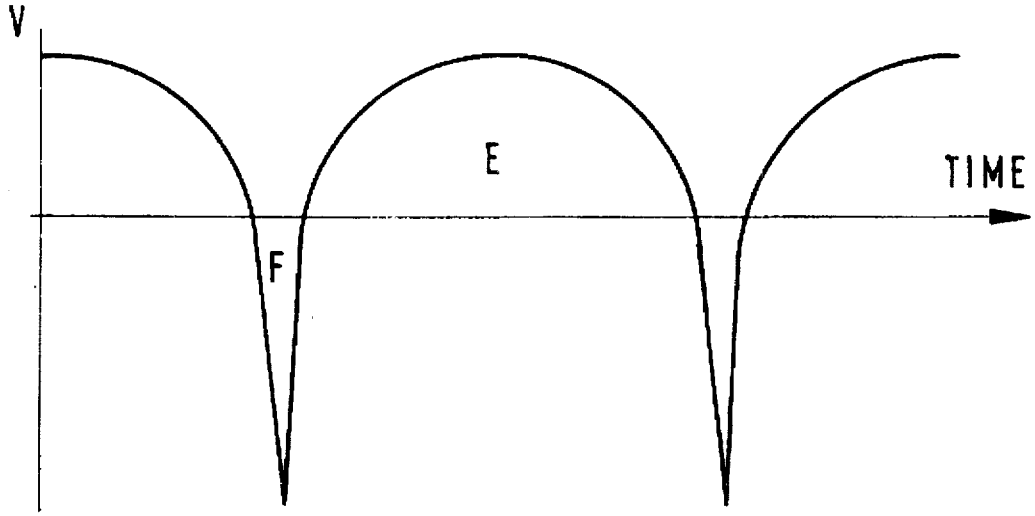

The workpiece is subjected to the action of an alternating electric current, whose frequency is preferably in the range of 0.25 or 0.5 to 10 Hz. The wave shape (in a graph of voltage against time) may be sinusoidal or triangular or square or any convenient shape. The voltage is usually chosen to be as high as possible, while avoiding localised hot spots, so as to effect treatment in the shortest possible time. The typical continuous commercial line may operate at 30 to 60 V and 50 to 200 $A/dm^2$. Some examples below were performed on laboratory equipment operating at 7 V AC, but the same principles would apply to commercial equipment.

a) In one embodiment, an anodic potential is imposed on the workpiece during the AC treatment. Reference is directed to FIG. 9 of the accompanying drawings, which is a graph of potential against time of the workpiece undergoing AC electrochemical graining. In the absence of any imposed bias, the waveform is symmetrical and the area A is equal to the area B. In practice, there is a natural cathodic bias, so that the area B is somewhat larger than the area A. When the potential of the workpiece is biased in an anodic direction, the area C becomes larger than the area D as shown in FIG. 10. In this way, the efficiency of the system is improved. The work done while the workpiece is cathodic, represented by the area D, is sufficient for effective pit nucleation and initiation. The work done while the workpiece is anodic, represented by the area C, is optimised for pit growth. The potential of the anodic bias is preferably from 0.1 to 0.6 of the rms AC voltage.

b) In another embodiment, the AC waveform is such that the workpiece is at an anodic potential for more than half the duration of an AC cycle. A system of this kind is shown in FIG. 11, where the cathodic part of the charge imput is shown as a high voltage pulse, of short duration but nevertheless sufficient for effective pit nucleation and initiation. Most of the time, the workpiece is at an anodic potential suitable for pit growth. The areas E and F may be similar, or alternatively the area F may be less than the area E.

Figure 12:
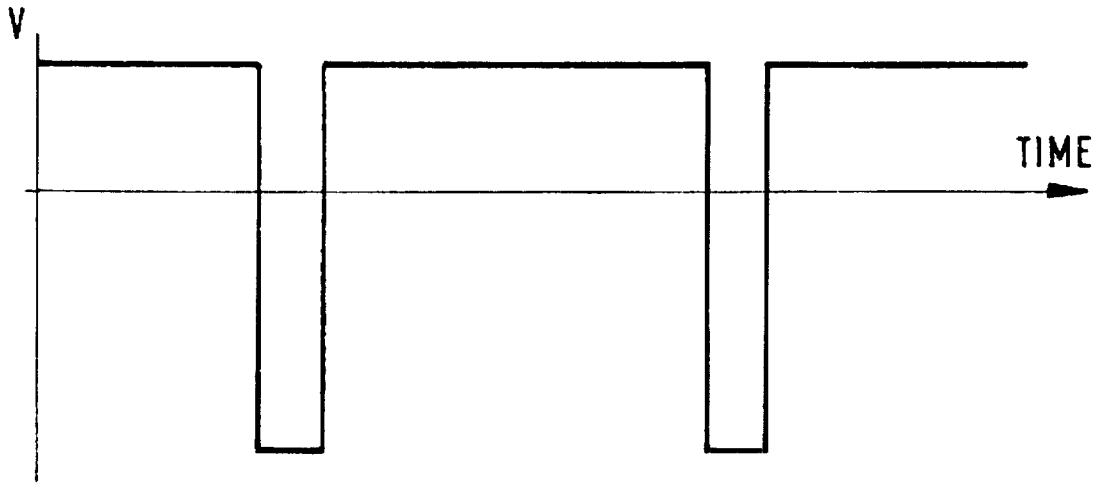

Preferably the ratio of the area C to the area D; and also the ratio of the area E to the area F; is in the range 1.0:1 to 3.0:1. The shape of the AC waveform is immaterial, as noted above. FIG. 12 corresponds to FIG. 11 except that a rectangular waveform has been used.

The AC frequency figures given above imply that each AC cycle has a duration of 4 to 0.04 s, preferably 2 to 0.1 s. During each AC cycle, the workpiece is preferably at an anodic potential from 2 to 0.04 s particularly from 1 to 0.1 s. At relatively high frequency, it is thus preferred that the duration of the cathodic part of the AC cycle should be relatively short.

c) According to another embodiment, the surface of the workpiece may have previously been coarsely roughened. A coarsely roughened surface may have an average spacing between adjacent peaks of a few microns to a few hundred microns, suitable to provide a good moisture-receptive surface for a lithographic plate. The method of the invention can then be used to provide a more finely pitted texture, with pits of average diameter typically in the range of 0.2 to 20 μm, such as provides an effective base for a firmly bonded organic layer as required in lithographic plates.

Coarse roughening can be achieved by a variety of techniques. Scratch brushing or slurry brushing the surface can be used. The surface can be electrochemically roughened under conditions to promote pit growth. The facing surfaces of pack rolled aluminum sheet or foil often have suitably coarse roughened properties.

d) The total coulombic charge input to the workpiece may be in the range of 10 to 60 $kC/m^2$. This is much less than commercial electrograining treatment of conventional Al alloy sheet which typically requires an AC input of at least 75 $kC/m^2$. In particular, the positive coulombic charge input, during which the workpiece is at an anodic potential, is preferably in the range of 5 to 30 $kC/m^2$. The reason for these lower figures is that the electrical energy is being used more efficiently, with both amount and duration being optimised, for pit nucleation and initiation on the cathodic side, and for pit growth on the anodic side.

e) The AC treatment of the aluminum workpiece may be continued for less than 25 s, and peferably less than 10 s, particularly less than 5 s. An example below shows that a suitable choice of conditions can result in full electrograining of an aluminum litho sheet in as little as 3 s. Again, this results from the efficient use of the energy input.

An electrograining treatment lasting only a few seconds at low AC frequency uses only a few AC cycles. Thus only 3 AC cycles were used to make the sheet shown in FIG. 7. One or 1.5 AC cycles may be sufficient provided that an adequate (cathodic) pit initiation stage is followed by an adequate (anodic) pit growth stage.

Low frequency supplies are not necessarily expensive. There are at least two methods of approach. One is to use two DC supplies one positive and the other negative with respect to the aluminum web and to chop between them using power thyristors. A second method is shown in FIG. 8 and relies on the velocity of the strip causing the surface to be exposed to alternating positive and negative potentials. The level of treatment can be made independent of linespeed. If more anodic treatment than cathodic is required in a liquid contact cell, or vice versa, then the excess current can be used to either cathodically clean or anodise as described in WO 92/21975. If a short but intense cathodic treatment is desired then clearly the length of the electrodes imparting the cathodic treatment to the strip will be much shorter than those producing the anodic treatment on the strip.

Some workers believe that a plate having a range of pit sizes is more robust to printing press set up conditions than one having a highly uniform finish. Should such a finish be desired then it is only a matter of electrode geometry to arrange for different levels of anodic treatment for each period experienced during passage of the strip down the line.

The aqueous electrolyte used in the method of the invention can be one used in conventional electrochemical graining processes. Electrolytes based on nitric acid are preferred, but those based on hydrochloric acid are also possible. Conventional additives to such electrolytes include boric acid with nitric acid, and acetic, tartaric, formic and other organic acids with hydrochloric acid. Electrolyte concentration is preferably in the range 1 to 250 g/l, preferably 5 to 100 g/l, and the electrolyte temperature is preferably from 20° to 60° C. Temperature has only a small influence on graining speed.

The roughness imparted by the method of this invention may be used to provide a sound base for adhesive and to improve adhesion. The grained surface will be suitable for resistance welding and weldbonding. The grained workpiece may be used as capacitor foil, or more particularly as lithographic plate support. The workpiece may be of pure aluminum or of an alloy containing a major proportion of aluminum. Alloys conventionally used to make lithographic plate supports by electrochemical roughening, are suitable for use, and include those found in the 1000, 3000, 5000 and 6000 Series, e.g. 1050A of the Aluminum Association designation.

The graining method of the invention can be used to make the surface whiter, which may be cosmetically desirable when the surface is to be anodised. For this purpose, pits should preferably have an average diameter of at least 0.8 μm.

EXPERIMENTAL

The following experiments were performed in a laboratory microcell using various low frequency AC voltages for various times both with and without an imposed DC bias. The alloy used was AA1050A (Fe 0.38; Si 0.08;, Ti 0.01; balance Al+normal impurities), the electrolyte was 1% nitric acid used at ambient temperature, and the electrode spacing was 15 mm. Results are set out below and illustrated in the accompanying FIGS. 1 to 7, which are photomicrographs in which (unless otherwise stated) the magnification is 1200 times, so that 10 μm equals 1.2 cm. The following table shows the estimated coulombic charge input used to grain each surface, both the total input and the anodic (+ only) input.

| | Charge Density (k Coulombs/$m^2$) | |
|---|---|---|
| Figure | Anodic input | Total |
| * 1 | 34 | 89 |
| 2 | 21 | 44 |

-continued

| Figure | Charge Density (k Coulombs/m²) Anodic input | Total |
|---|---|---|
| * 3a, 3b | 56 | 117 |
| * 4 | 56 | 117 |
| * 5 | 56 | 117 |
| 6a | 19 | 39 |
| 6b | 13 | 31 |
| 7 | 10 | 20 |

* comparison examples

FIG. 1 shows the surface topography of AA1050A alloy lithographic sheet after it has been subjected to standard laboratory graining conditions, that is to say 7 V AC for 30 s, 50 Hz frequency with a 1 V DC cathodic bias on the Al sheet. The surface is very typical of a commercial nitric acid grained finish. The time taken to fully grain the surface in the laboratory microcell is 30 s. Considerable material removal is necessary to achieve the appropriate roughness, to ensure that all of the surface has been covered with pits and the roll lines are no longer visible. At least 15 to 20 s of this time is required to ensure full coverage. Using low frequency conditions, coverage can be achieved in much shorter times, see FIGS. 2, 6 and 7.

FIG. 2 was generated using 7 V AC for 10 s at 0.25 Hz frequency, with a 3 V DC anodic bias. The pit sizes are more uniform and slightly finer than those produced under commercial conditions. The coulombic charge input was less than half that required for the commercial graining, and the time was correspondingly shorter FIG. 3*a* shows a surface grained at 7 V AC for 30 s at 5 Hz frequency with a 2 V DC anodic bias.

FIG. 3*b* is a corresponding picture at 6440×magnification. The average pit size here is about 1 μm, less than shown in FIG. 2.

FIGS. 4 and 5 show the effect of frequency under conditions that are otherwise identical to FIG. 3. At 1 Hz, the average pit diameter is a few microns (FIG. 4). At 50 Hz (FIG. 5) there is considerable evidence of coarse pitting of 10 to 100 μm in addition to finer pits.

The beneficial effect that anodic biasing can achieve is demonstrated in FIG. 6. FIG. 6*a* shows that complete coverage was achieved using 7 V AC for 10 s at 1 Hz frequency with a 2 V DC anodic bias.

FIG. 6*b* was obtained under corresponding conditions but without the anodic bias, and shows that coverage was incomplete.

FIGS. 7*a* and 7*b* are corresponding pictures at 1210×and and 6410×magnification. These pictures have been generated using 10 V AC for as little as 3 s at 1 Hz frequency with a 5 V DC anodic bias. This relatively large bias has resulted in surprisingly rapid and complete coverage of the surface. Again, the pits are of a highly uniform size.

FIG. 8 shows an arrangement for using a DC current source to subject a continuous aluminum web to low frequency AC. A web 10 is continuously passed through a bath 12 containing nitric acid electrolyte. Arranged in the bath is a series of electrodes 14, 16, wired up so as to be alternately a positive electrode 14 and negative electrode 16. The potential of the aluminum web is correspondingly biased as it passes beneath each electrode. A DC anodic bias can also be imposed on the web 10 via a voltage source 18.

On such grained aluminum workpieces, additional etching and anodizing steps can be performed to apply a protective oxide layer onto the workpiece surface. Methods for applying such a protective oxide layer are, for example, described in European patent EP-B-0 269 851. Further methods which are disclosed as prior art in this document, are also applicable.

Following graining or, in the case of several graining steps, between the individual steps, it is possible to perform an additional etching treatment, during which in particular a maximum amount of about 2 g/m² is removed (between the individual steps, even up to 5 g/m²). Etching solutions in general are aqueous alkali metal hydroxide solutions or aqueous solutions of salts showing alkaline reactions or aqueous solutions of acids on a basis of $HNO_3$, $H_2SO_4$ or $H_3PO_4$. Apart from an etching treatment step performed between the graining step and the anodizing steps, nonelectrochemical treatments are also known, which have a purely rinsing and/or cleaning effect and are, for example, employed to remove deposits which have formed during graining ("smut"), or simply to remove electrolyte remainders: dilute aqueous alkali metal hydroxide solutions or water can, for example, be used for these treatments. In many cases, however, it is not necessary to perform a treatment of this kind, since the anodizing electrolyte has an adequate etching action.

The step of an anodic oxidation of the aluminum support material is optionally followed by one or several post-treating steps. In particular when the process of this invention is employed, these post-treating steps are often not required. Post-treating particularsly means a hydrophilizing chemical or electrochemical treatment of the aluminum oxide layer, for example, an immersion treatment of the material in an aqueous solution of polyvinyl phosphonic acid according to German Patent No. 16 21 478 (=British Published Application No. 1,230,447) or an immersion treatment in an aqueous solution of an alkali-metal silicate according to German Auslegeschrift No. 14 71 707 (=U.S. Pat. No. 3,181,461). These post-treatment steps serve, in particular, to improve even further the hydrophilic properties of the aluminum oxide layer, which are already sufficient for many applications, with the other well-known properties of the layer being at least maintained.

The materials prepared in accordance with this invention are used as supports for offset printing plates, i.e., one or the two surfaces of the support material are coated with a photosensitive composition, either by the manufacturers of pre-sensitized printing plates or directly by the users. Suitable radiation-(photo-) sensitive layers basically include all layers which after irradiation (exposure), optionally followed by development and/or fixing, yield a surface in imagewise configuration which can be used for printing.

Apart from the silver halide-containing layers used for many applications, various other layers are known which are, for example, described in "Light-Sensitive Systems" by Jaromir Kosar, published by John Wileys & Sons, New York, 1965: colloid layers containing chromates and dichromates (Kosar, Chapter 2); layers containing unsaturated compounds, in which, upon exposure, these compounds are isomerized, rearranged, cyclized, or crosslinked (Kosar, Chapter 4); layers containing compounds which can be photopolymerized, in which, on being exposed, monomers or prepolymers undergo polymerization, optionally with the aid of an initiator (Kosar, Chapter 5); and layers containing o-diazoquinones, such as naphthoquinone-diazides, p-diazoquinones, or condensation products of diazonium salts (Kosar, Chapter 7). The layers which are suitable also include the electrophotographic layers, i.e., layers which contain an inorganic or organic photoconductor. In addition to the photosensitive substances, these layers can, of course, also contain other constituents, such as for example, resins, dyes or plasticizers. In particular, the following photosensitive compositions or compounds can be employed in the coating of the support materials prepared in accordance with this invention:

positive-working reproduction layers which contain o-quinone diazides, preferably o-naphthoquinone diazides, such as high or low molecular-weight naphthoquinone-(1, 2)-diazide-(2)-sulfonic acid esters or amides as the light-sensitive compounds, which are described, for example, in German Patents Nos. 854,890; 865,109; 879,203; 894,959; 938,233; 11 09 521; 11 44 705; 11 18 606; 11 20 273; 11 24 817 and 23 31 377 and in European Patents Nos. 0 021 428 and 0 055 814 negative-working reproduction layers which contain condensation products from aromatic diazonium salts and compounds with active carbonyl groups, preferably condensation products formed from diphenylaminediazonium salts and formaldehyde, which are described, for example, in German Patents Nos. 596,731; 11 38 399; 11 38 400; 11 38 401; 11 42 871 and 11 54 123; U.S. Pat. Nos. 2,679,498 and 3,050,502 and British Patent No. 712,606;

negative-working reproduction layers which contain condensation products of aromatic diazonium compounds, such as are, for example, described in German Patent No. 20 65 732, which comprise products possessing at least one unit each of a) an aromatic diazonium salt compound which is able to participate in a condensation reaction and b) a compound which is able to participate in a condensation reaction, such as a phenol ether or an aromatic thioether, which are connected by a bivalent linking member derived from a carbonyl compound which is capable of participating in a condensation reaction, such as a methylene group;

positive-working layers according to German Offenlegungschrift No. 26 10 842, German Patent No. 27 18 254 or German Offenlegungsschrift No. 29 28 636, which contain a compound which, on being irradiated, splits off an acid, a monomeric or polymeric compound which possesses at least one C-O-C group which can be split off by acid (e.g., an orthocarboxylic acid ester group or a carboxylic acid amide acetal group), and, if appropriate, a binder;

negative-working layers, composed of photopolymerizable monomers, photo-initiators, binders and, if appropriate, further additives. In these layers, for example, acrylic and methacrylic acid esters, or reaction products of diisocyanates with partial esters of polyhydric alcohols are employed as monomers, as described, for example, in U.S. Pat. Nos. 2,760,863 and 3,060,023, and in German Offenlegungsschriften Nos. 20 64 079 and 23 61 041;

negative-working layers according to German Offenlegungsschrift No. 30 36 077, which contain, as the photosensitive compound, a diazonium salt polycondensation product or an organic azido compound, and, as the binder, a high-molecular weight polymer with alkenylsulfonylurethane or cycloalkenylsulfonylurethane side groups.

It is also possible to apply photosemiconducting layers to the support materials prepared in accordance with this invention, such as described, for example, in German Patents Nos. 11 17 391, 15 22 497, 15 72 312, 23 22 046 and 23 22 047, as a result of which highly photosensitive electrophotographic printing plates are obtained.

I claim:

1. A method of electrochemically graining a surface of a plate-, foil- or web-shaped workpiece of aluminum or an aluminum alloy, which method comprises subjecting the workpiece in an electrolyte to an AC treatment of a voltage and an alternating current end voltage) having a frequency of 0.1 to 25 Hz, wherein a) an anodic potential is imposed on the workpiece during the AC treatment, b) the surface of the workpiece has previously been coarsely grained, and c) the alternating current results in a total charge input of anodic charge input and cathodic charge input of from 10 to 60 $Kc/m^2$.

2. A method as claimed in claim 1, wherein an AC waveform of the alternating current is such that the workpiece is at an anodic potential for more than half the duration of an AC cycle and the A c treatment in continued for less than 25 s.

3. A method as claimed in claim 1, wherein the anodic potential is imposed as an anodic bias and is in the range from 0.1 to 0.6 of the AC voltage.

4. A method as claimed in claim 1, wherein the ratio of the anodic charge input to the cathodic charge input is in the range of 1.0:1 to 3.0:1.

5. A method as claimed in claim 1 wherein the workpiece is an aluminum metal sheet which is electrochemically grained for use as a lithographic plate support.

6. A method as claimed in claim 1, wherein after the electrochemical graining an etching treatment is performed.

7. A method as claimed in claim 6, wherein the workpiece is a plate support and the method further comprises coating the electrochemically grained and etched surface of the plate support with a photosensitive layer, whereby a lithographic printing plate is produced.

8.. A method as claimed in claims 1, wherein the workpiece is anodically oxidized with direct current in an aqueous electrolyte.

9. A method as claimed in claim 8, wherein the workpiece is hydropholised after the anodic oxidation.

10. A method as claimed in claim 8, wherein the workpiece is a plate support and the method further comprises coating the electrochemically grained and anodically oxidized surface of the plate support with a photosensitive layer, whereby a lithographic printing plate is produced.

11. A method as claimed in claim 1, wherein the workpiece is a plate support and the method further comprises coating the electrochemically grained surface of the plate support with a photosensitive layer, whereby a lithographic printing plate is produced.

12. A method as claimed in claim 11, wherein the photosensitve layer, which may be colored is comprising diazonium compounds, o-diazoquinones, condensation products of aromatic diazonium salts and compounds with active carbonyl groups or photopolymerizable compounds.

* * * * *